US007388505B2

(12) United States Patent
White

(10) Patent No.: US 7,388,505 B2
(45) Date of Patent: Jun. 17, 2008

(54) STORAGE CONTAINER SMART COLLAR

(76) Inventor: Wesley Jack White, 6219 Squires Ct., Spring, TX (US) 77389

( * ) Notice: Subject to any disclaimer, the term of this patent is extended or adjusted under 35 U.S.C. 154(b) by 206 days.

(21) Appl. No.: 11/325,040

(22) Filed: Jan. 4, 2006

(65) Prior Publication Data

US 2006/0158332 A1 Jul. 20, 2006

Related U.S. Application Data

(60) Provisional application No. 60/641,545, filed on Jan. 5, 2005.

(51) Int. Cl.
*G08B 13/14* (2006.01)

(52) U.S. Cl. ..... 340/572.8; 340/572.1; 340/572.3; 222/1

(58) Field of Classification Search ..... 340/572.1, 340/572.3, 572.8
See application file for complete search history.

(56) References Cited

U.S. PATENT DOCUMENTS 5,602,530 A * 2/1997 Holmgren ..... 340/572.1
5,831,531 A * 11/1998 Tuttle ..... 340/568.2
6,036,055 A * 3/2000 Mogadam et al. ..... 222/23
6,050,622 A * 4/2000 Gustafson ..... 292/307 R
6,137,413 A * 10/2000 Ryan, Jr. ..... 340/572.8
6,226,619 B1 * 5/2001 Halperin et al. ..... 705/1
6,236,319 B1 * 5/2001 Pitzer et al. ..... 340/573.4
6,326,890 B1 * 12/2001 Costa ..... 340/572.9
6,891,474 B1 * 5/2005 Fletcher ..... 340/572.1
7,028,861 B2 * 4/2006 Sayers et al. ..... 222/1
7,061,379 B2 * 6/2006 Chen et al. ..... 340/572.1
7,224,273 B2 * 5/2007 Forster ..... 340/539.1
7,259,674 B2 * 8/2007 Marsilio et al. ..... 340/572.1
7,265,673 B2 * 9/2007 Teller ..... 340/572.1
2003/0001725 A1 * 1/2003 Moore ..... 340/10.3
2005/0107923 A1 * 5/2005 Vanderveen ..... 700/282
2005/0276883 A1 * 12/2005 Jeffrey et al. ..... 426/106
2006/0038683 A1 * 2/2006 Claessens et al. ..... 340/572.1

* cited by examiner

*Primary Examiner*—Davetta W. Goins
*Assistant Examiner*—Kerri McNally
(74) *Attorney, Agent, or Firm*—Buskop Law Group, PC; Wendy Buskop

(57) ABSTRACT

A security system for a container connected to a device includes a collar connected to a device requiring the contents of the refillable container. The collar has a top with a diameter that matches the diameter of the filling portion of a container. The system has a band with a security wire to prevent tampering, and a chip in communication with the security wire wherein the chip includes memory, and contacts. The system has one or more connections for facilitating receiving and transmitting data from the chip and a connector for communicating between the chip and a processor. The processor reads the chip via the connector and confirms that the information in the processor is identical to the information from the chip and provides a transmission to a device to accept the contents of the container.

19 Claims, 11 Drawing Sheets

STORAGE CONTAINER SMART COLLAR

CROSS REFERENCE TO RELATED APPLICATIONS

The present application claims priority to now abandoned U.S. Provisional Patent Application Ser. No. 60/641,545, filed on Jan. 5, 2005.

FIELD

The embodiments relate generally to security devices for filling or refilling storage containers.

BACKGROUND

In the storage container refilling industry, a common problem is that the correct contents are not put in the correct containers. The mixture of two different contents can create a volatile mixture and become very dangerous. Theft is another problem faced by the storage container industry. The present tanks can be used with any common valve connections, thus thieves do not have any trouble using a stolen container.

In other cases, manufacturers that require specific chemicals for their machines to work properly need to be assured that the material in the container is exactly what they require for their equipment to work properly. If the container is filled with material that does not meet the specifications, the machinery may fail and the result will not only damage the equipment, but can also place the operator or other persons in the area in danger.

In addition, situations commonly arise where one needs to know the contents of a transport container without invasive testing. Should an emergency arise, immediate knowledge of the contents would aid in rescue and life saving measures. When the containers are used to house and transport multiple items or volumes, the supplier, shipper, manufacturer, and recipient along with all government and law enforcement officials need to be able to ascertain and verify the contents of the container using speedy and non invasive methods.

Containers are designed to hold specific contents; if the wrong materials are placed in a specific container, a dangerous and hazardous condition could be created. Anyone near the container could be injured if a container failed. The contents, if exposed, could be toxic and pose a threat to the life in a larger area. A device is needed to assure that specific materials are placed in correct and approved containers. This device needs to provide information instantly as to the history, requirements and current status of the container and its contents. This device can save lives by preventing the wrong materials from being placed in wrong containers.

A need exists to prevent refilling a storage container with the wrong contents.

A need exists to prevent the theft of storage container by preventing the use of the container after the container is stolen.

A need exists to verify the contents of the container prior to and during its use.

A need exists to verify that a container that is designed to contain only one type of material actually only contains that material.

A need exists for a container that is designed so that the container can contain multiple items and can be sealed against tampering with or theft of the contents.

A need exists for a means to assure users that the seal of the container has not been tampered with.

The present embodiments meet these needs.

BRIEF DESCRIPTION OF THE DRAWINGS

The detailed description will be better understood in conjunction with the accompanying drawings as follows.

Figure 1:
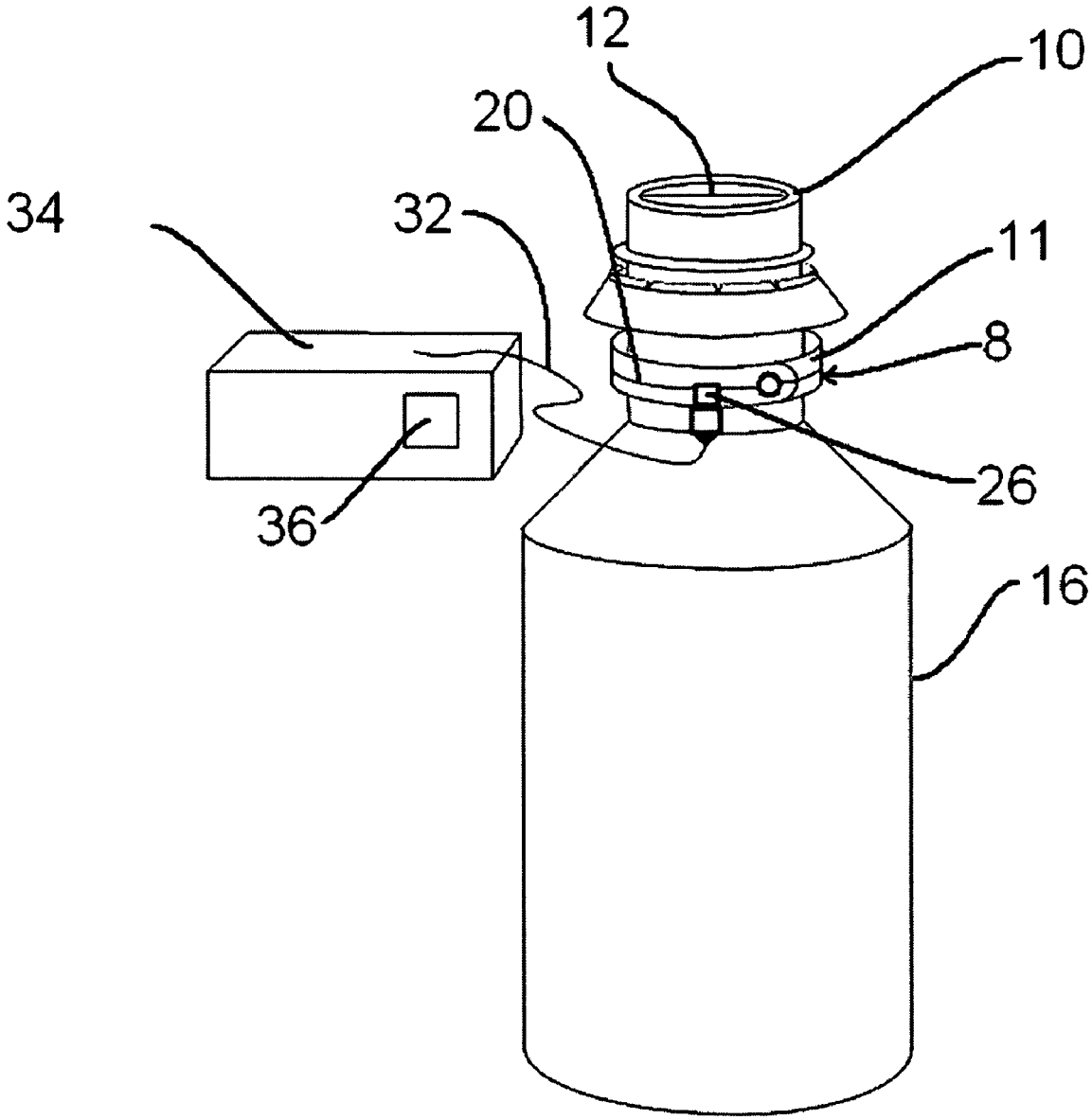
FIG. 1 depicts an example storage tank with an embodiment of a collar installed thereon.

The present embodiments are detailed below with reference to the listed Figures.

DETAILED DESCRIPTION OF THE EMBODIMENTS

Before explaining the embodiments in detail, it is to be understood that the embodiments are not limited to the particular embodiments and that it can be practiced or carried out in various ways.

The embodiments are directed at smart collar security devices that can prevent tampering with or improper use of a sealed container. The embodied smart collar security devices store information that is readable by a reading device. Examples of stored information can be the contents of the container, the date the contents were put in the container, the date/time the device was activated, and the storage specifications, such as temperature. The security device can include other information relevant to the container or the contents of the container, such quantity, clean-up procedures, and origin of the contents.

The devices are of significant benefit to manufacturers, transportation workers, those who handle containers, and authorities that monitor the containers contents. For example, the devices can inform anyone who needs to know the history of the container, the contents, the instructions for filling the container, and instructions on how to use the contents for its specified purpose. The embodied devices can provide an indication of the harm the container or its contents can do to equipment, transportation devices, and—most importantly—to the persons who must handle the containers or the material in the containers.

A reader or scanner can be used with the embodied security devices to check instantly the information contained on a chip and learn the history and the status of both the container and the contents. The reader can connect directly to the chip, can interpret emissions (such as, radio waves) from the chip and transmitter, and/or can reflect the data back to the reader from a proximity chip. The reader allows information to accessed, interpreted and acted upon instantly.

The embodiments can provide increased safety around machinery because the machines can shut down if the information the machinery receives from the chip on the container differs from the specifications required by the machinery to operate.

The embodied devices can provide a tamperproof so that the seal can be permanently attached to the chip by the collar, strap, or wire. If the collar, strap, or wire is removed or broken, the chip registers the change. This change allows the person who receives the container or the machinery to reject automatically both the container and the contents prior to creating a dangerous situation that can arise from the use of an unauthorized container contents or incompatible container contents.

The embodied devices provided instant information so that storage of containers and their contents can be made safer by easily identifying sensitivities to the environment, (for example, heat, cold, or light) where the materials must be kept in an area specifically design for them. The embodied devices can inform the chip readers of the requirements for the container or the material and such information can be acted upon automatically by qualified persons.

An embodiment of a security system for a container connected to a device includes a collar. The collar can have a top with a diameter that matches the diameter of the filling portion of a container and sides connected to the top for securely engaging the refillable container. The collar can be connected to a device that requires the contents of the refillable container. Alternatively, the collar does not have to be connected to a device requiring the contents of the container; rather, the device can function as a standalone container not attached to a device for refilling or removing the contents of the container. An example of a container usable herein is Royal Oval Model #33-430 available from Plastic Bottle Corporation located in Libertyville, Ill. A device usable herein to connect the collar to the container is a Noritsu/Fuji/Konica Model QSS2301 available from Fuji Film Corporation located in Japan. The embodiments can be used with refillable containers.

The embodied devices can be used as a security system, wherein the devices include a band with a security wire that can be used with the collar or the container with the features of the collar embedded therein. The band can be located between the sides of the collar and the refillable container. In an alternative embodiment, the band can be attached to a container without the use of a collar, such as a shipping container or a tank, where collar does not easily attach to a specific device for refilling and removing the contents of the container.

In one embodiment, the band of the embodied device has a first end and a second end; and the wire has a first wire end and a second wire end. The first end of the band corresponds to the first end of the wire and the second end of the band corresponds to the second end of the wire. The band is used to surround the filling portion of the container or refillable container. Alternatively, the band can be used through an orifice in a door of a shipping container. The band forms a circuit by connecting the first wire end with the second wire end. The security wire prevents removal of the collar or the band from the container. If the security wire is tampered with by cutting, the chip is disabled and prevents further refills to the refillable container. The shape of the collar and/or band can be based on the shape of the refillable container.

The embodied security systems utilize a chip to communicate with the security wire. The chip includes memory that has processing capabilities so that the chip can communicate with a processor. The processor connects to the chip through a connector enabling the processor to receive and transmit data. An access code and information regarding the quality and use of the product in the container can be saved in the memory of the chip. The processor can read the access code and additional information from the chip via the connector and can confirm that the information in the processor memory is identical to the information on the chip. If the information is identical, the container is considered usable by the system. In one embodiment, the processor sends a transmission to accept the contents of the container. The chip is can be turned on when the refillable container is refilled and the chip can be turned off when the refillable container is emptied by the device. An example of a chip usable herein is a model CLXU64KF6/T=OED-GSM available from Cardlogix located in Irvine, Calif. An example of a processor usable herein is a model CLXU128KJ8/T=OED-GSM available from Cardlogix located in Irvine, Calif.

In one example embodiment, the transmission sent by the processor can communicate with a valve on the collar or embedded in the container. The valve can be opened by the transmission to permit a product into the refillable container. Once the refillable container is full, the valve closes; and the information on the chip is updated by the processor connected to the chip through the connector enabling the chip to contain current information. As examples, the transmission can be from a vendor either requiring the contents of the refillable container or can be from a vendor refilling the refillable container to a manufacturer's central computer to validate the refillable container. The transmission can be from a party inquiring about the contents of the container, such as a shipping company handling the container in transit.

The chip can contain various pieces of data. For example, the chip has include information related to the product to be held by the container, instructions on use of product in the container, authorizations allowing a user with permission to use the product stored in the refillable container. The chip can store authorizations allowing a user to replace the contents of a container. These authorizations ensure compatibility of a refilling material with the original material in the refillable container. The chip can contain information on the type of equipment adapted for use with the product in the container and any other useful information.

In another embodiment of the security system, the security wire is integral with the collar. The collar has a top with a diameter that matches the diameter of the filling portion of a refillable container and the collar has sides connected to the top for securely engaging the refillable container. The collar is connected to a device that requires the contents of the refillable container, such as a printer or a copy machine. A security wire is integrated into the collar or the wire can be the collar. The security wire forms a completed circuit in the collar. A separate band to hold the security wire is not necessary is this embodiment, but can be used if needed.

In another embodiment of the security system, a band is includes, but not a collar. This embodiment is created from a band for a refillable container connected to a device, where the device requires the contents of the refillable container. The band can attach around the filling portion of a refillable container. The band can include a security wire integrated into the band forming a completed circuit in the band to prevent removal of the band.

In an alternative embodiment, a band containing a wire or wire itself is used without a band connected to the chip. The band or wire can be weaved through two or more orifices that ensure access doors to a container or box are shut and sealed. This embodiment can contain a connection so that the access doors cannot be opened without destroying the wire's connectivity. The band or wire can form a complete circuit to prevent removal of or tampering with the band.

With reference to the figures, FIG. 1 depicts an example storage tank or container (16) with an embodiment of a collar installed thereon. The collar (8) has sides (11) and a top (10) connected to the sides to form the collar (8). A hole cut in the top (10) of the collar (8) has a diameter (12) that corresponds to the size of the valve on the refillable container (16). The chip (26) is connected to the security wire (20). The chip is connected via a connector (32) to the processor (34) with memory (36).

Figure 2:
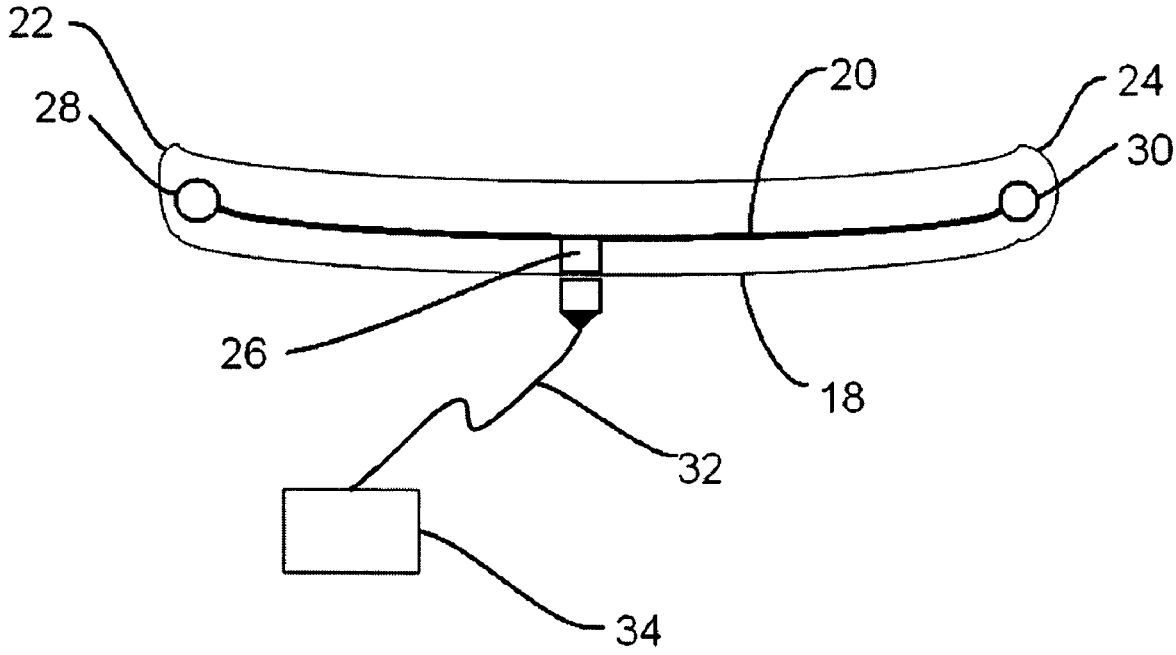
FIG. 2 depicts an example of a chip, a band, and a wire incorporated into an embodiment of a collar.

FIG. 2 depicts an example of a chip, a band, and a wire incorporated into an embodiment of a collar. The band (18) has a first end (22) and a second end (24).

The band (18) has a security wire (20) integrated into the band (18). The security wire (20) has a first wire end (28) and a second wire end (30). The first and second wire ends can connect to each other when installed on a refillable container. The security wire (20) is connected to the chip (26). The chip (26) is shown connected to the connector (32) and the connector is connected to the processor (34).

Figure 3:
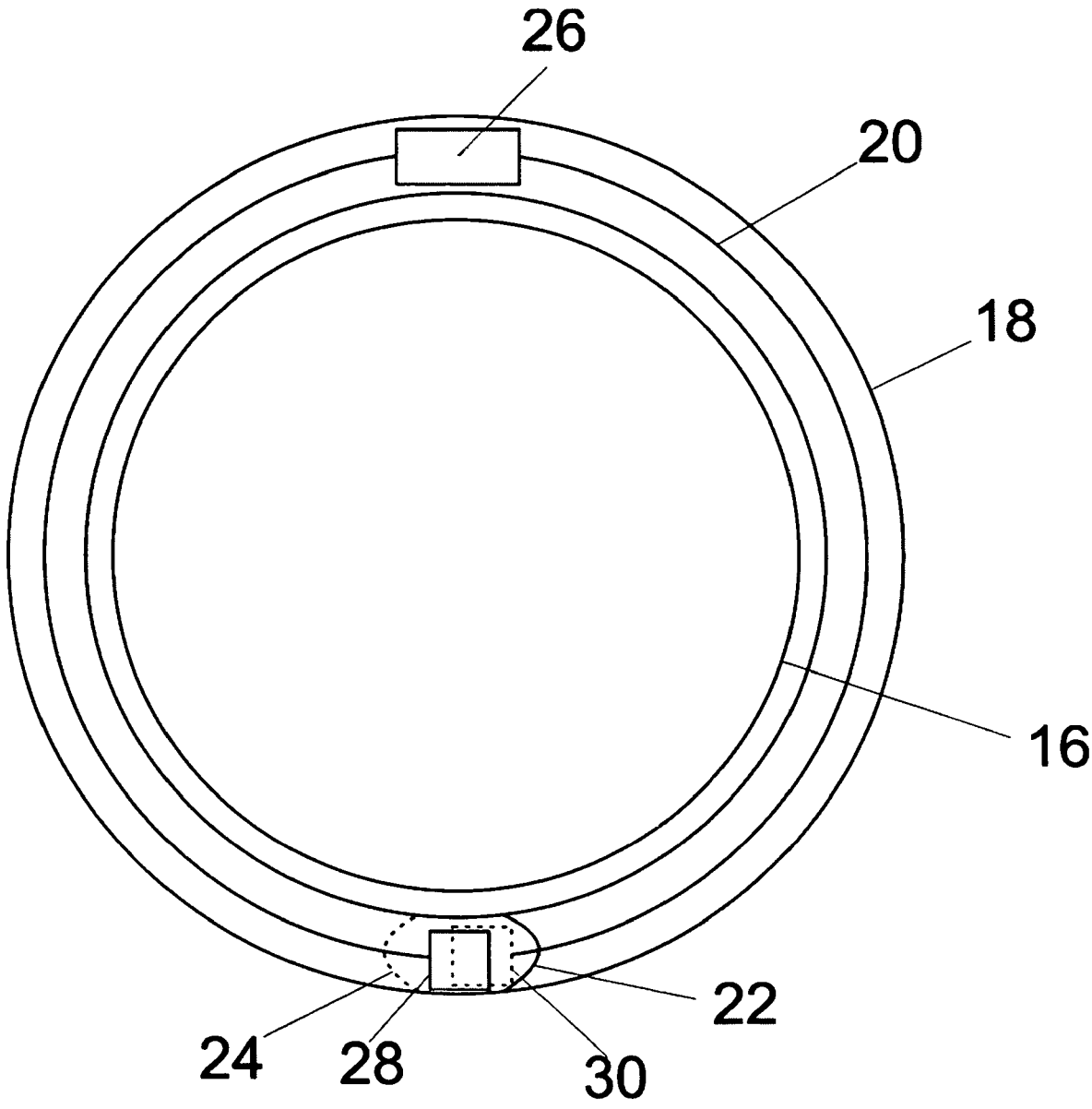
FIG. 3 depicts a top view of an embodiment of the band and collar.

FIG. 3 depicts a top view of an embodiment of the band (18) and collar. The band (18) has two ends: a first end (22) and a second end (24). The band (18) has an integrated security wire (20). The security wire has a first wire end (28) and a second wire end (30). The first and second wire ends connect to prevent tampering or removal of the band (18). A chip (26) is integrated into the band (18) and is connected to the security wire (20).

Figure 4:
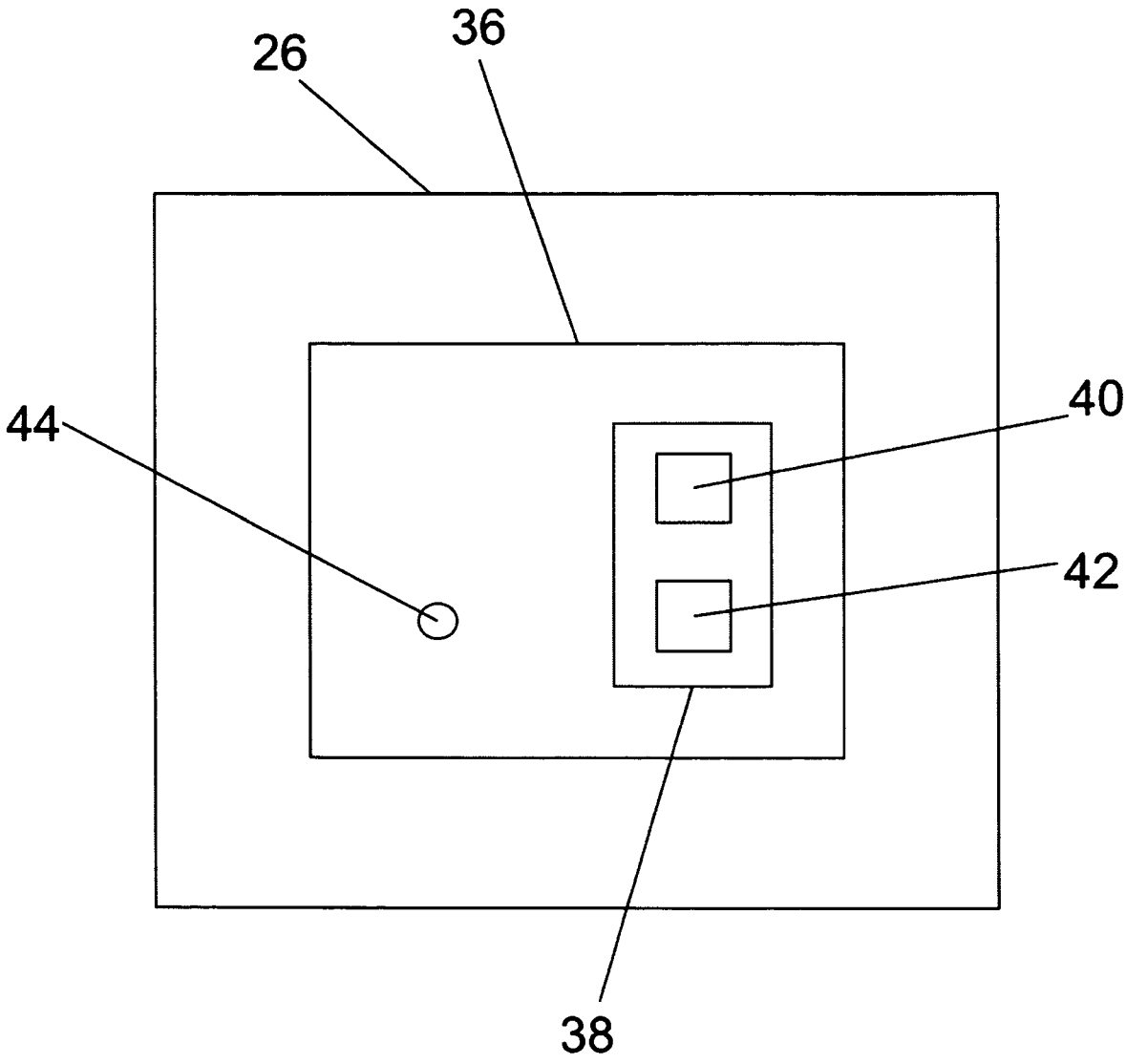
FIG. 4 depicts an example chip for use in an embodiment of a collar.

FIG. 4 depicts an example chip (26) for use in an embodiment of a collar. The chip (26) has at least one connection (44) for transmitting and receiving data from the chip. The chip (26) has memory (38) with processing capabilities (36). An access code (40) and additional information (42) is typically stored in the memory (38).

Figure 5:
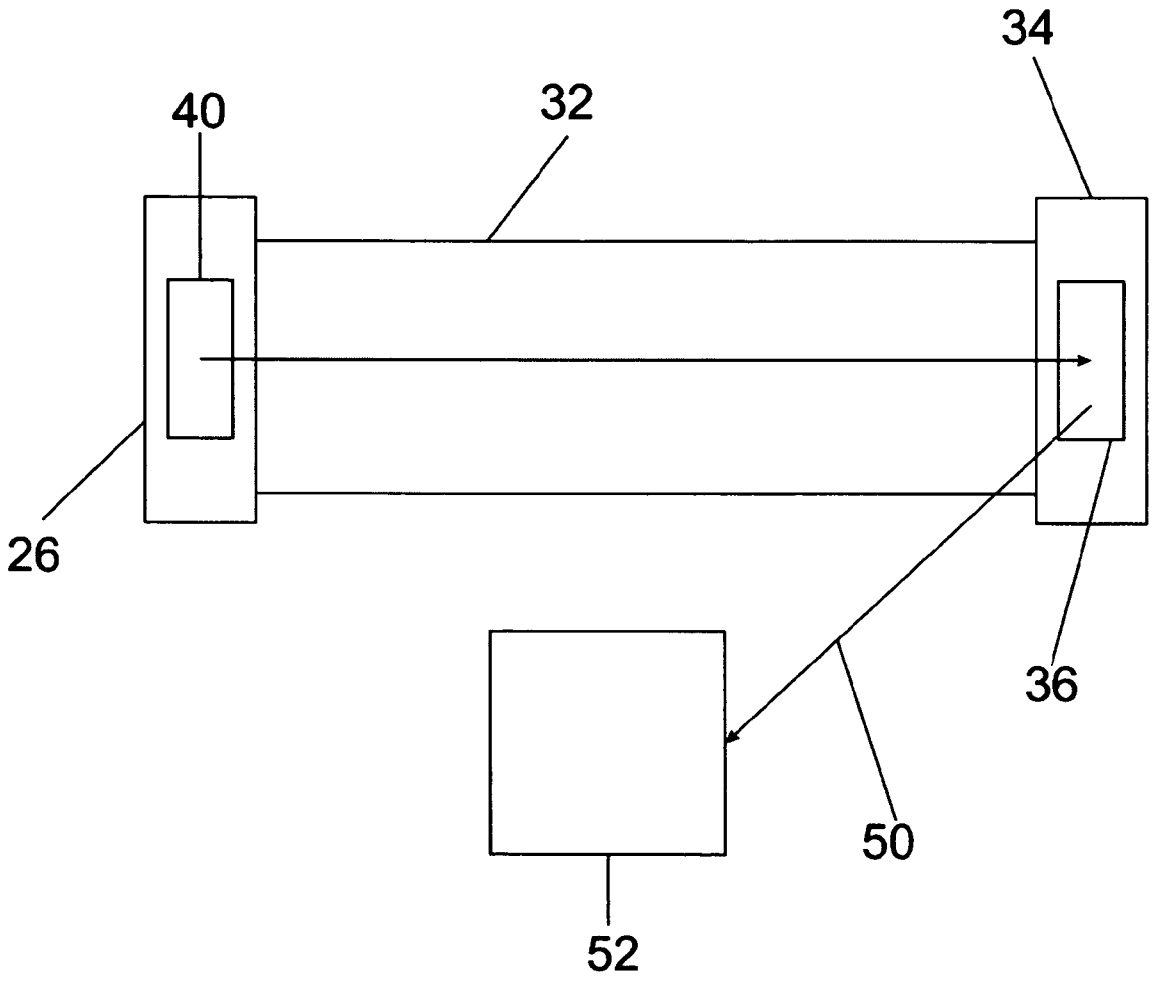
FIG. 5 depicts an example band and a wire in an embodiment of a collar.

FIG. 5 depicts an example band and a wire in an embodiment of a collar. The chip (26) has an access code (40) contained in the memory of the chip (26). The access code is transmitted to the processor (34) by a connector (32) and is compared to the access code stored in the processor memory (36). The processor (34) then sends a transmission (50) to a device (52). The device makes the decision whether to accept or reject the contents of the refillable container.

Figure 6:
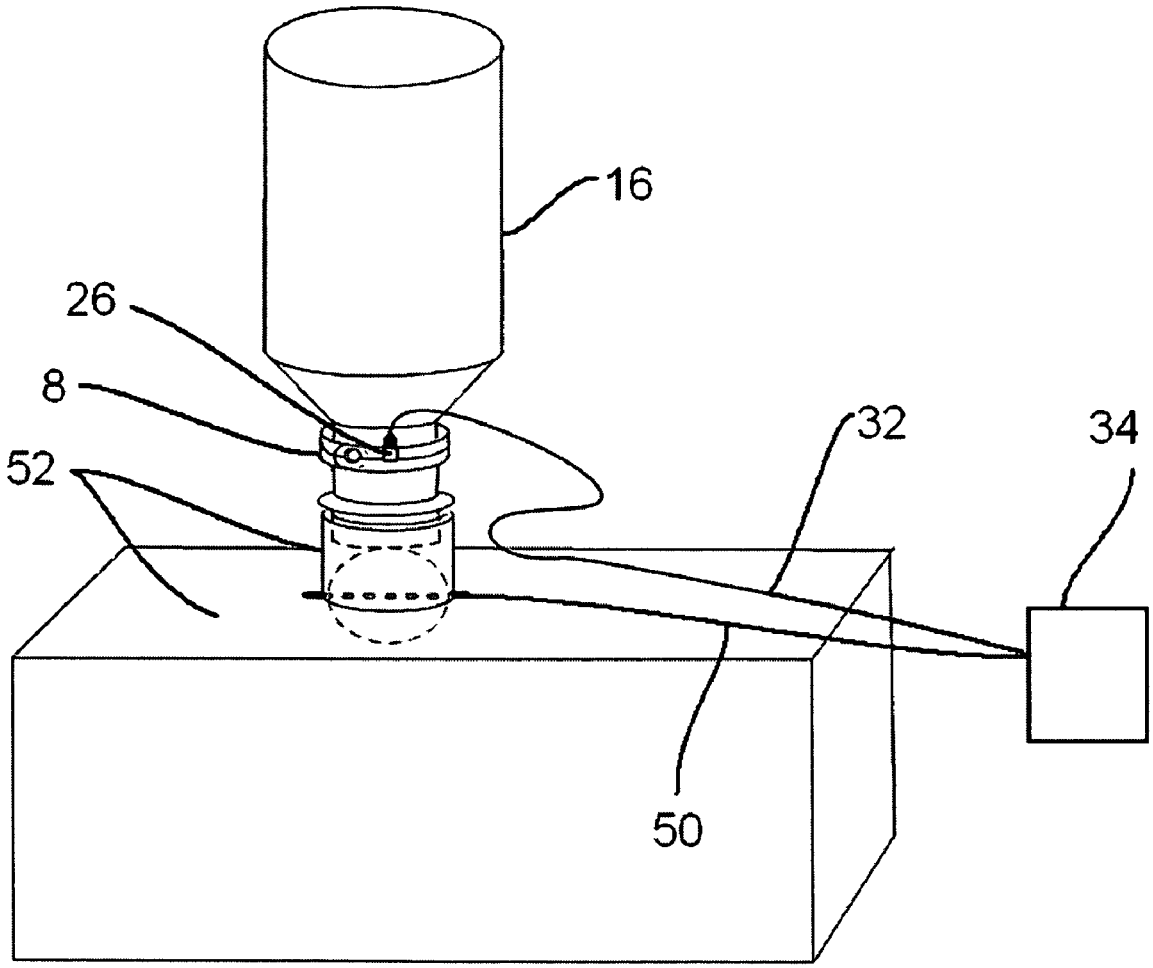
FIG. 6 depicts an embodiment of the device in an example use.

FIG. 6 depicts an embodiment of the device in an example use on a refillable container (16). The chip (26) is attached to the collar (8) that is mounted on the refillable container (16). The chip sends a signal by way of a connector (32) to a processor (34). The processor then sends a signal to a device (52) requiring the contents of the refillable container by a transmission (50).

Figure 7:
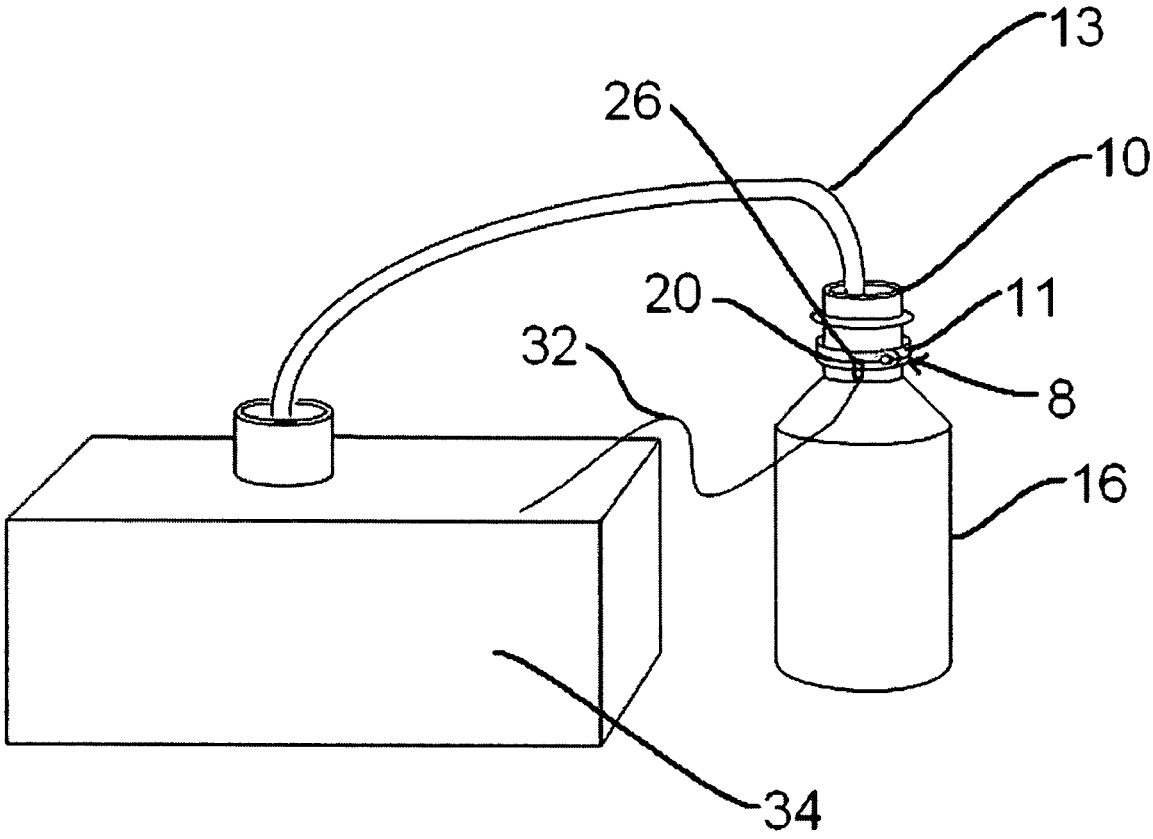
FIG. 7 depicts an embodiment of the device in another example use.

FIG. 7 depicts an embodiment of the device in another example use on the refillable container (16). The refillable container (16) is being filled or emptied by a tube (13) inserted in the top (10) and is not directly attached to the device requiring or filling the contents of the refillable container (16). The chip (26) is attached to the collar (8) that is mounted on the refillable container (16). The chip then sends a signal by way of a connector (32) to a processor (34). The chip (26) is connected to the security wire (20) embedded in the sides (11) of the collar (8).

Figure 8:
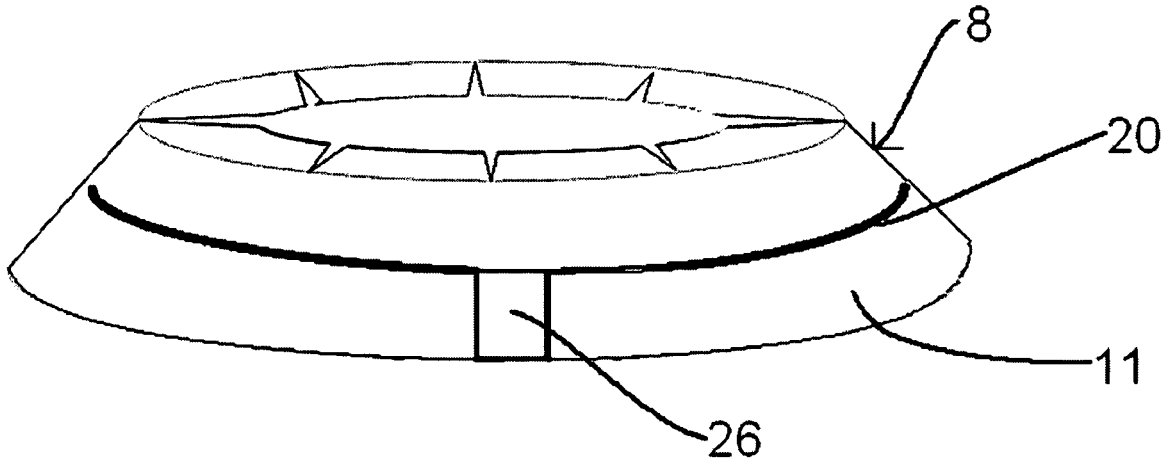
FIG. 8 depicts an embodiment of a collar.

FIG. 8 depicts an embodiment of a collar (8). The collar has a security wire (20) attached to the chip (26). The security wire (20) and the chip (26) are attached to the sides (11).

Figure 9:
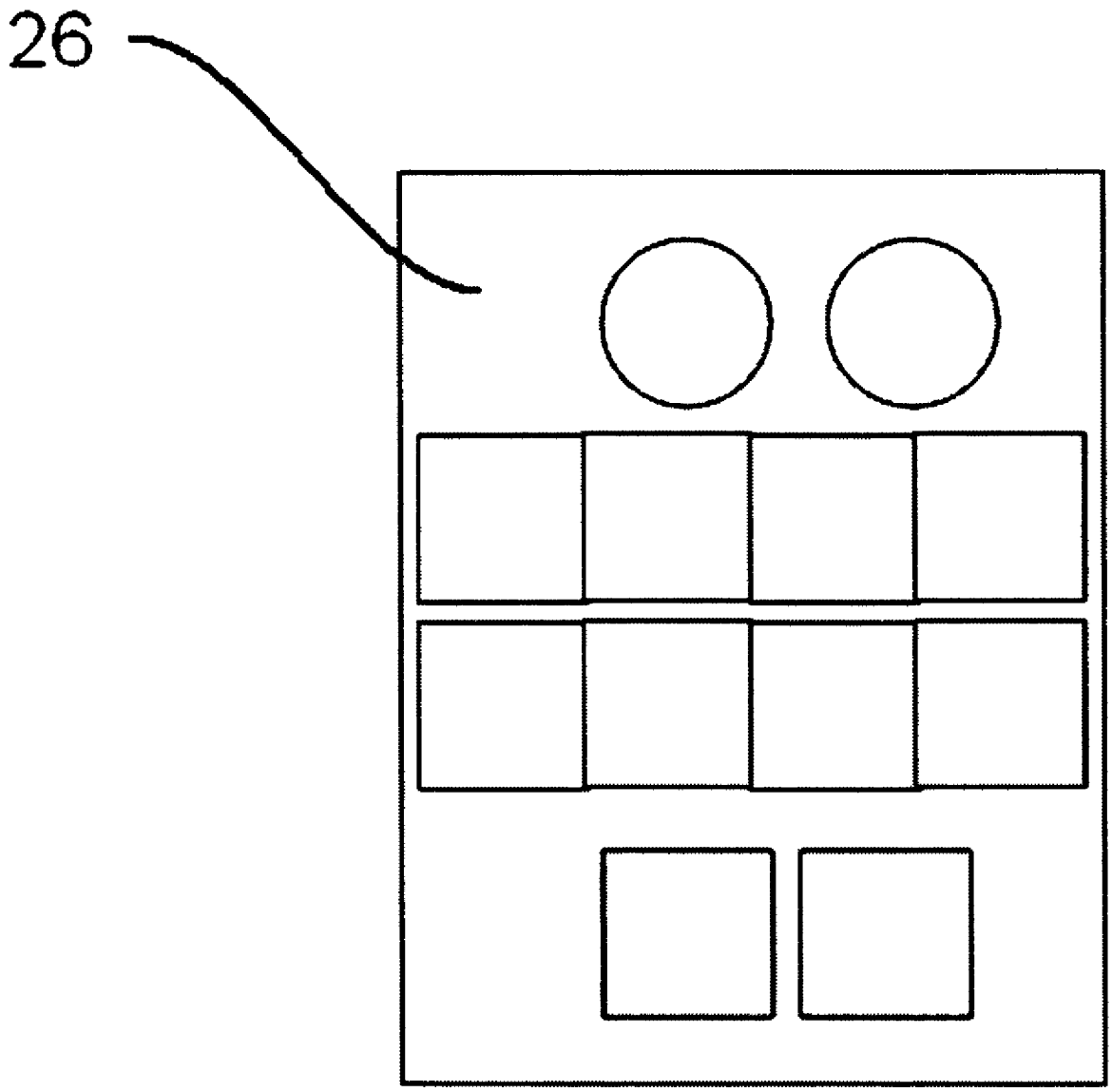
FIG. 9 depicts an example chip usable in an embodiment of a collar.

FIG. 9 depicts an example chip (26) usable in an embodiment of a collar. The squares represent connection points for attaching the connector (32) not shown in the figure.

Figure 10:
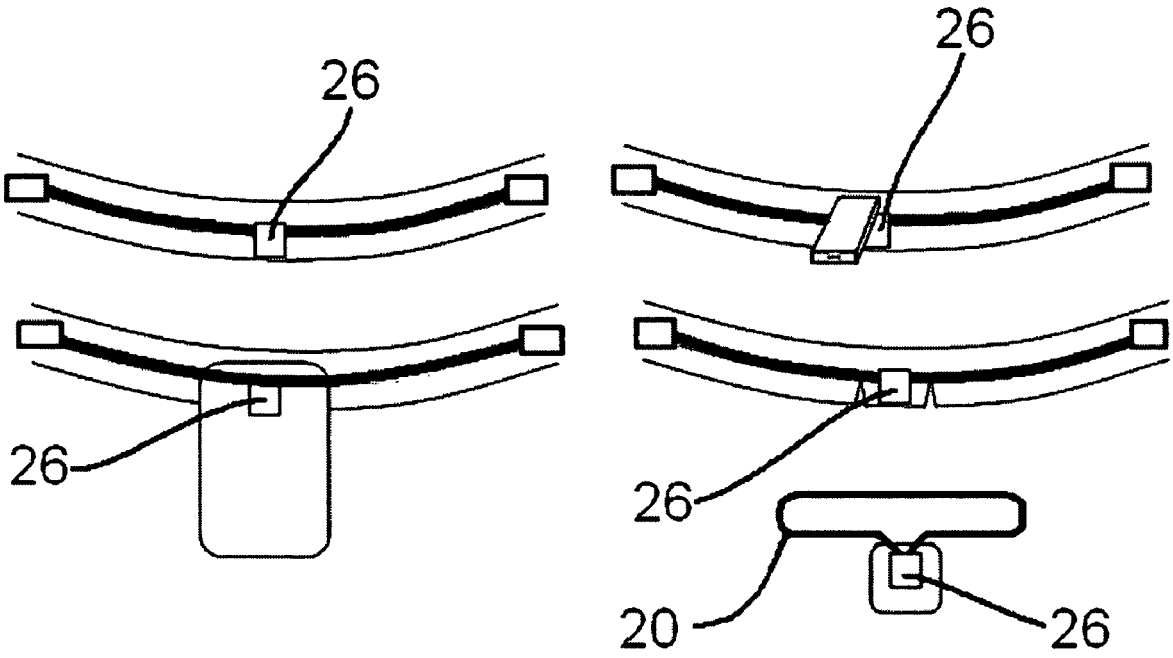
FIG. 10 depicts the various example mountings of a chip on a band for an embodiment of a collar.

FIG. 10 depicts the various example mountings of a chip (26) on a band for an embodiment of a collar. The chip can be mounted directly on the band or collar. The chip can be mounted under a cover attached to the band. The chip can be mounted on a part separate from the band or collar. The chip can be mounted between two notches in the collar and the band. The notches can facilitate the tearing of the band should the collar or band be tampered with. The chip can be connected to the wire (20) without the use of a band.

In another embodiment, the device includes a tamper-proof refill nozzle seal. A special refill assembly is required to refill the refillable container. If the special refill assembly is not used and the seal is broken, the refillable container cannot be refilled.

Figure 11:
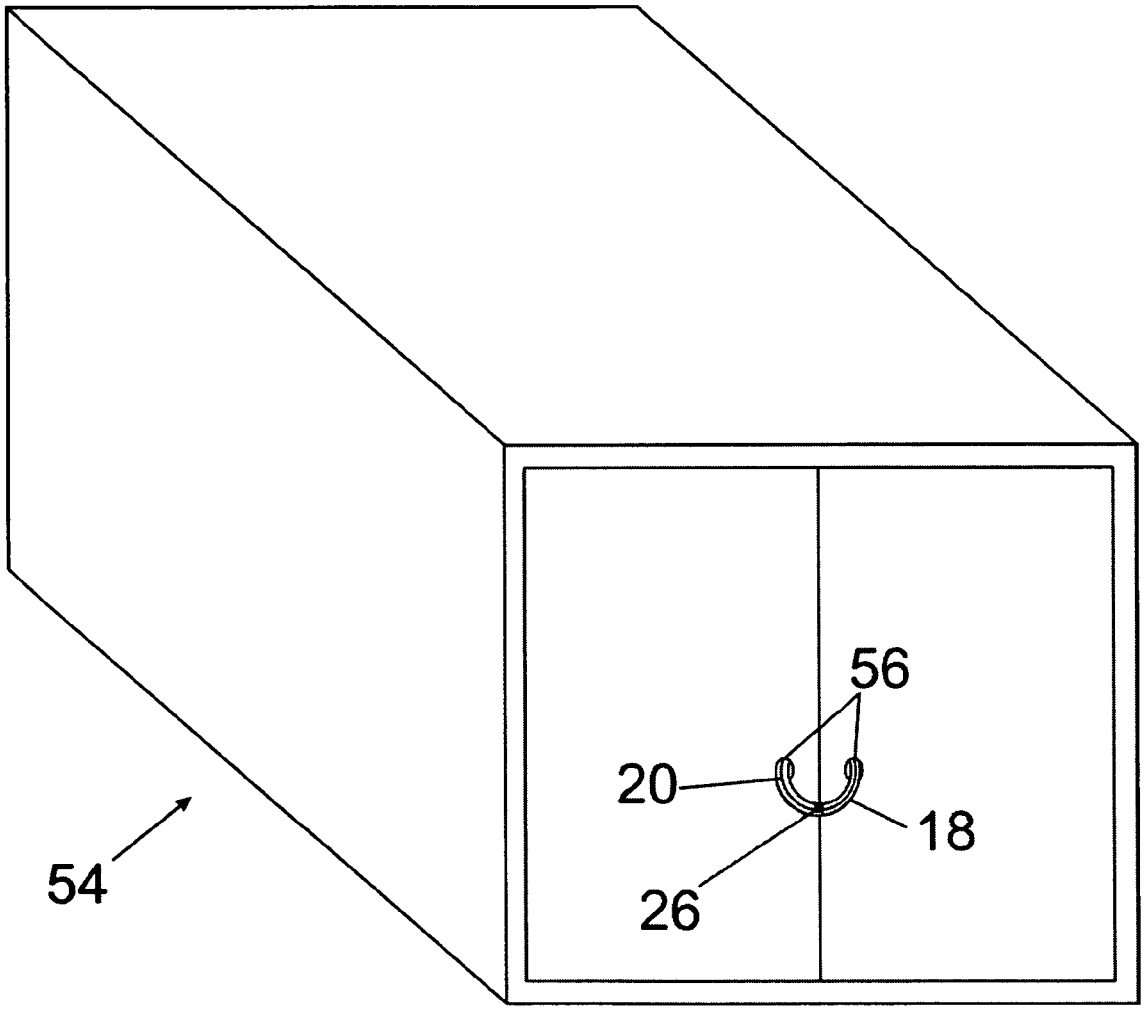
FIG. 11 depicts an example band and a wire attached to a shipping container.

FIG. 11 depicts an example band (18) and a wire (20) attached to a shipping container (54). The band is shown attached to a shipping container (54). The shipping container (54) has two holes (56) through the doors. In this embodiment, once the doors to the container are locked and the band is attached, a content's list can be accessed by reading the chip (26), thereby preventing tampering with the contents of the container. The embodiment is depicted on a large shipping container, but the device can be used on any size container, such as a filing cabinet, a suit case or other luggage, a safe, or any container with a lid or a door.

While these embodiments have been described with emphasis on the preferred embodiments, it should be understood that within the scope of the appended claims, the embodiments might be practiced other than as specifically described herein.

What is claimed is:

1. A security system for a refillable container connected to a device, wherein the security system comprises:

a. a collar for a refillable container, wherein the collar is connected to a removing device, wherein the removing device requires the contents of the refillable container, wherein the collar has a top with a diameter that matches the diameter of the filling portion of a refillable container and sides connected to the top for securely engaging the refillable container;

b. a band with a security wire, wherein the band has a first end and a second end and the wire has a first wire end within the first end and a second wire end within the second end, and wherein the band engages the filling portion of the refillable container and forms a circuit by connecting the first wire end with the second wire end and wherein the band fits between the sides and the refillable container;

c. a chip in communication with the security wire wherein the chip comprises: memory with a processor;

i. memory with a processor;

ii. an access code saved in the memory;

iii. additional information saved in the memory concerning the quality and use of product in the container;

iv. contacts; and v. at least one connection for facilitating receiving and transmitting data from the chip;

d. a connector for communicating between the chip; and e. a processor with processor memory for engaging the connector, wherein the processor reads the access code and additional information from the chip via the connector and confirms that the information in the processor memory is identical to the information from the chip, thereby validating the contents of the container as usable; and provides a transmission to the removing device to accept the contents of the container.

2. The system of claim 1, wherein the transmission communicates with a valve, wherein the valve is opened by the transmission to permit product in the refillable container to flow into device.

3. The system of claim 1, wherein the code embedded on the chip comprises a member selected from the group consisting of information on the product to be held in the container; instructions on use of product in the container; authorizations to use the product held in the container; authorizations to replace the contents of the container to insure compatibility of refilling material with the original material in the container; information on the type of equipment adapted for use with the product in the container; and combinations thereof.

4. The system of claim 1, wherein the collar is a conical shape.

5. The system of claim 1, further comprising a refill nozzle seal, wherein the refill nozzle seal is broken if an attempt is made to refill the refillable container without a special assembly.

6. A security system for a refillable container connected to a device, wherein the security system comprises:

a. a collar for a refillable container, wherein the collar is connected to a removing device, wherein the removing device requires the contents of the refillable container, wherein the collar has a top with a diameter that matches the diameter of the filling portion of a refillable container and sides connected to the top for securely engaging the refillable container; and a security wire integral with the collar wherein the security wire forms a completed circuit in the collar;

b. a chip in communication with to the security wire wherein the chip comprises:

i. memory with a processor;

ii. an access code saved in the memory;

iii. additional information saved in the memory concerning the quality and use of product in the container;

iv. contacts; and v. at least one connection for facilitating receiving and transmitting data from the chip;

c. a connector for communicating with the chip;

d. a processor with processor memory for engaging the connector, and wherein the processor reads the access code and additional information from the chip via the connector and confirms that the information in the processor memory is identical to the information from the chip, thereby validating the contents of the container as usable; and provides a transmission to the removing device to accept the contents of the container.

7. The system of claim 6, wherein the transmission communicates with a valve, wherein the valve is opened by the transmission to permit product in the refillable container to flow into device.

8. The system of claim 6, wherein the code embedded on the chip comprises a member selected from the group consisting of information on the product to be held in the container; instructions on use of product in the container; authorizations to use the product held in the container; authorizations to replace the contents of the container to insure compatibility of refilling material with the original material in the container; information on the type of equipment adapted for use with the product in the container; and combinations thereof.

9. The system of claim 6, wherein the collar is a conical shape.

10. The system of claim 6, further comprising a refill nozzle seal, wherein the refill nozzle seal is broken if an attempt is made to refill the refillable container without a special assembly.

11. A security system for a refillable container connected to a device, comprising:

a. a band with a security wire, wherein the band has a first end and a second end and the wire has a first wire end within the first end and a second wire end within the second end, wherein the band engages a removing device of a filling portion of the refillable container, wherein the removing device requires the contents of the container, and wherein the band forms a circuit by connecting the first wire end with the second wire end; and b. a chip in communication with the security wire wherein the chip comprises: memory with a processor; an access code saved in the memory; additional information saved in the memory concerning the quality and use of product in the container; contacts; and at least one connection for facilitating receiving and transmitting data from the chip; and c. a connector for communicating with the chip.

12. A security system for a container, wherein the security system comprises:

a. a band encompassing a security wire, wherein the security wire comprises a first wire end and a second wire end, wherein the band engages an openable portion of the container, wherein the openable portion requires the contents of the container, and wherein a circuit is formed in the band by connecting the first wire end with the second wire end;

b. a chip in communication with the security wire, wherein the chip comprises memory with information pertaining to the container disposed thereon, and wherein the information indicates whether the circuit is complete;

c. a processor in communication with the chip, wherein the processor reads the information from the chip via a connector and confirms that the information in the chip is identical to information in a database.

13. The security system of claim 12, wherein the processor is in communication with a valve, wherein the processor instructs the valve to open to permit product to flow into the container.

14. The security system of claim 12, farther comprising a collar encompassing the band, wherein the collar is connected to a removing device on the container.

15. The security system of claim 12, wherein the chip comprises memory and a connection for facilitating receiving and transmitting data from the chip.

16. The security system of claim 12, wherein the chip farther comprises an access code.

17. The security system of claim 12, wherein the information is selected from the group consisting of information on the product to be held in the container; instructions on use of product in the container; authorizations to use the product held in the container; authorizations to replace the contents of the container to insure compatibility of refilling material with the original material in the container, information on the type of equipment adapted for use with the product in the container; and combinations thereof.

18. The security system of claim 12, wherein the processor is remotely located from the chip.

19. The security system of claim 12, wherein the container is a shipping container, a filing cabinet, a suitcase, a brief case, a container with a lid, or a container with a door.

* * * * *